United States Patent [19]

Bazen

[11] 4,114,343

[45] Sep. 19, 1978

[54] STACKING RACKS

[76] Inventor: Badger R. Bazen, Rte. #1, Box 163, Johnsonville, S.C. 29555

[21] Appl. No.: 807,688

[22] Filed: Jun. 17, 1977

[51] Int. Cl.[2] ..... E04C 3/32

[52] U.S. Cl. ..... 52/665

[58] Field of Search ..... 52/648, 93, 90, 634, 52/643, 665, 86

[56] References Cited

U.S. PATENT DOCUMENTS

| | | | |
|---|---|---|---|
| 2,027,882 | 1/1936 | Ross | 52/643 |
| 2,666,507 | 1/1954 | Ruark | 52/643 |
| 3,483,879 | 12/1969 | Oehmsen | 52/86 |

*Primary Examiner*—John E. Murtagh

*Attorney, Agent, or Firm*—Cushman, Darby & Cushman

[57] ABSTRACT

The disclosure embraces a protective frame for the interior wall of a warehouse of the type having interior beams for supporting the walls and includes a grid structure consisting of vertical posts extending from the floor of the structure and horizontal cross members releasably secured to adjacent beams of the building and intersecting the vertical posts to define the grid structure; the cross members are provided with reinforcing trusses which also function to connect the cross members to the vertical posts at the intersections thereof.

4 Claims, 6 Drawing Figures

STACKING RACKS

BACKGROUND AND SUMMARY OF THE INVENTION

The present invention relates to protective frame structure for the interior walls of buildings and, more particularly, to building structures such as warehouses or barns where the walls consist of panels such as sheet metal that are secured to a skeletal frame.

In many industrial storage environments, it has become common practice to construct warehouses by casting a concrete floor and then erecting a support frame which usually consists of I-beams which extend generally vertically from the floor and span the roof of the structure. Between the I-beams, on the exterior thereof, spanning girders or wall support members are erected to which the sheet metal panels are attached as by bolting or welding to enclose the structure.

While such structures have enjoyed widespread use due to the relative ease and speed with which they can be constructed, damage to the sheet metal panels as a result of collision with industrial trucks, loading equipment or falling materials stored within the warehouse has required expensive repair operations which have sometimes resulted in the loss of the use of the entire warehouse while the repair operations were being carried out.

Since the chief attractiveness of these warehouse structures is the speed with which they can be constructed and the low maintenance and construction costs, relative to the volume of space enclosed thereby, designers of such structures have long sought inexpensive yet effective means for preventing separation of the sheet metal panels due to industrial accidents.

It is an object of the present invention to provide a protective interior frame for such structures which can be easily assembled and disassembled and yet one which will minimize if not eliminate damage to the sheet metal panels constituting the walls of the warehouse from the type of industrial accidents that have occurred in the past in such structures.

In a preferred embodiment, the present invention provides a protective frame which is spaced a selected distance inwardly from the inner surface of the sheet metal wall panels and which can withstand the forces generated as a result of collision with an industrial truck operating at least at normal speeds on the order of 5 m.p.h.

The protective frame of the present invention is adapted to cooperate with the interior support columns of warehouses and, thus, the invention provides a grid structure consisting of vertical posts evenly spaced between adjacent beams of an existing structure as well as cross members which are spaced vertically, preferably evenly, along the posts to a desired height along the wall of the structure. The cross members are secured at their ends to the adjacent beams or girders of the building and are also provided with reinforcing trusses which span substantially the entire length of each cross member between the adjacent beams. Additionally, the reinforcing members include connecting means for securely attaching the cross members to the vertical posts at each intersection of a cross member with a vertical post of the protective frame. Further, according to the present invention the cross members are disposed interiorly of the vertical post so that it is the vertical posts that are disposed between the cross members and the sheet metal walls of the building.

With such an arrangement, where a collision occurs either from falling material or from collision with industrial vehicles such as a fork lift truck, the truss means of each cross member and the interconnections of the cross members to both the vertical posts and the beams of the existing structure will distribute the collision forces over substantially an entire grid structure so that the collision force will be absorbed thereby and prevent the colliding object from reaching the relatively lightly secured sheet metal panels constituting the walls of the building.

From the description that follows, it will also be seen that a distinguishing feature of the present invention is the ease and speed with which it can be assembled in an existing warehouse and the relatively low cost that will be involved in producing and installing such a protective frame.

The foregoing and other advantages will become apparent as consideration is given to the following detailed description taken in conjunction with the accompanying drawings, in which:

DETAILED DESCRIPTION OF THE INVENTION

Figures 1, 2:
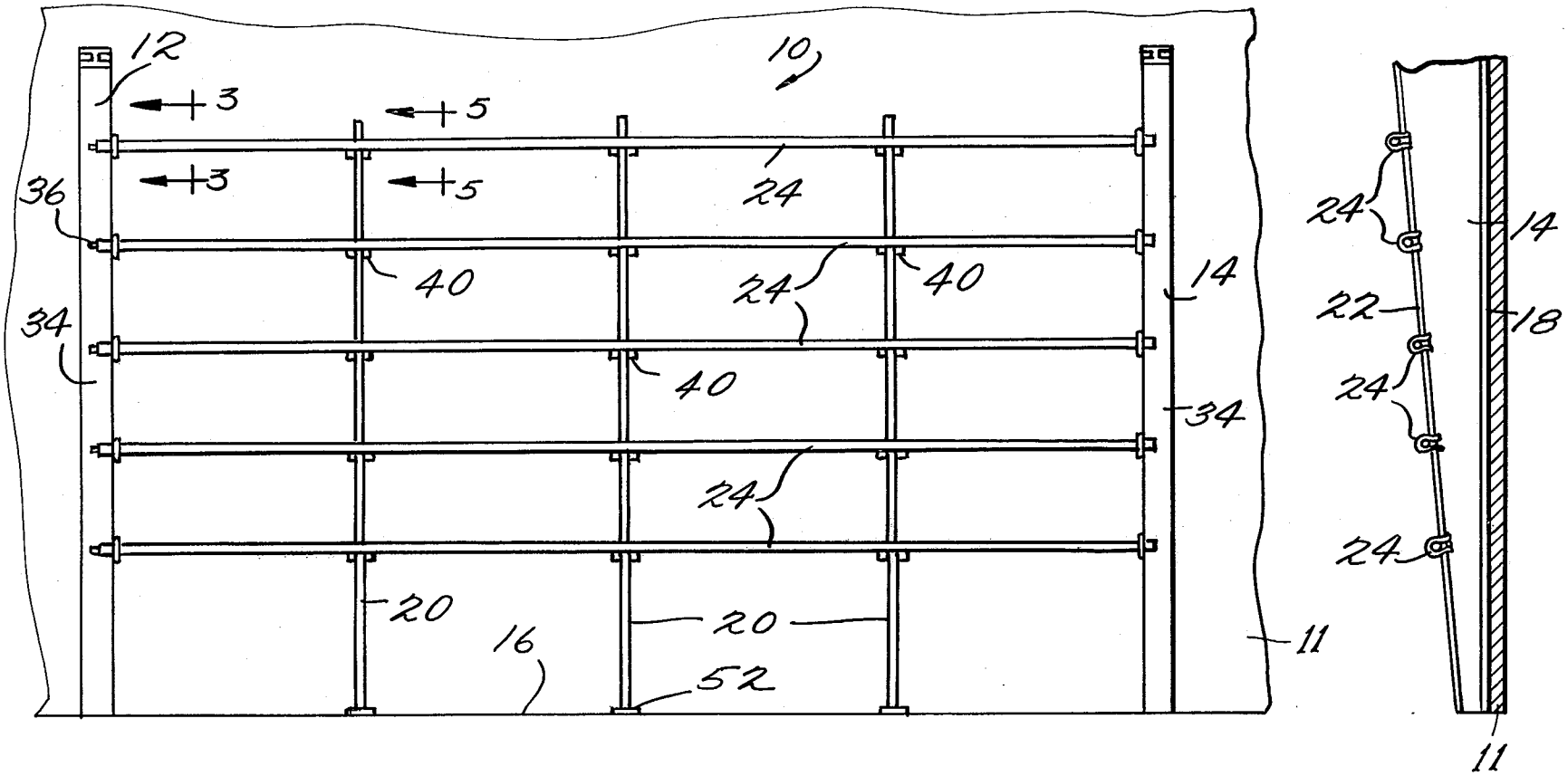
FIG. 1 is a front view in elevation of one grid structure section according to the present invention installed between two adjacent beams.
FIG. 2 is a side view in elevation of the arrangement of FIG. 1.

Referring now to the drawings, wherein like numerals designate corresponding parts through the several views, there is illustrated in FIGS. 1 and 2 front and side views respectively, of a grid structure generally designated at 10 of the present invention which spans the space between vertical girders 12 and 14. The girders 12 and 14 are securely mounted on the floor 16 of a warehouse structure and extend generally vertically therefrom. The walls of the warehouse one of which is shown at 11, as is conventional, would be mounted securely to the exterior side 18 of the girders although auxiliary sheet metal panel supports may be employed between the girders such as are disclosed in U.S. Pat. Nos. 2,871,997 and 2,989,154.

The grid structure 10 includes a plurality of vertical posts 20 which are preferably evenly spaced between the building structure girders 12 and 14. The lower ends of each of the posts 20 are securely fastened to the floor 16 so that each post 20 extends either pependicular to the floor 16 or at a slight angle thereto conforming to the angle of inclination of the inside edge 22 of each of the girders.

Figure 3:
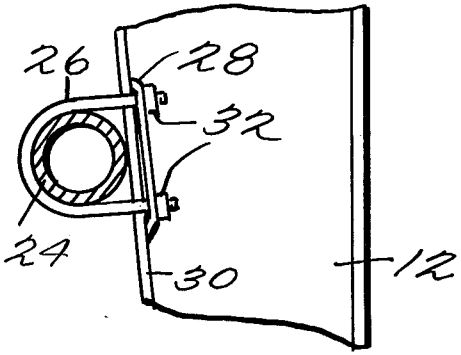
FIG. 3 is a view along lines 3—3 of FIG. 1.

A plurality of horizontally extending cross members 24 extend between the adjacent girders 12 and 14 of the structure with each end of each cross member 24 being secured to the respective girders as shown in FIG. 3.

As illustrated in FIG. 3, a U-shaped clamp 26 surrounds the end of a cross member 24 with the free ends of the legs of the U-shaped clamp extending through a plate 28 which has down turned legs on the opposite sides thereof which engage the flange 30 of the associated girder. Bolts 32 are employed to tightly secure the U-shaped clamp, cross member 24, plate 28 and the flange 30 together. However, it will be noted that the U-shaped clamp 26 does not physically engage any part of the girder so that, in the event of a collision, it will be possible for the interconnection of the cross member 24 to the associated girder to give way thereby lessening the chance of damage to the girder or other structural parts of the building occurring.

The ends of the cross members opposite the section taken along lines 3—3 are mounted in an identical fashion as illustrated in FIG. 3 to girder 14.

As shown more clearly, in FIG. 1, the ends of the cross members 24 extend substantially half way across the face 34 of each of the girders 12 and 14. The ends of the cross members 24 lying on face 34 of girder 12 are provided with extensions as at 36 to facilitate interconnection between a similar grid structure spanning the distance between the girder adjacent to girder 12 on the left as viewed in FIG. 1.

Figure 4:
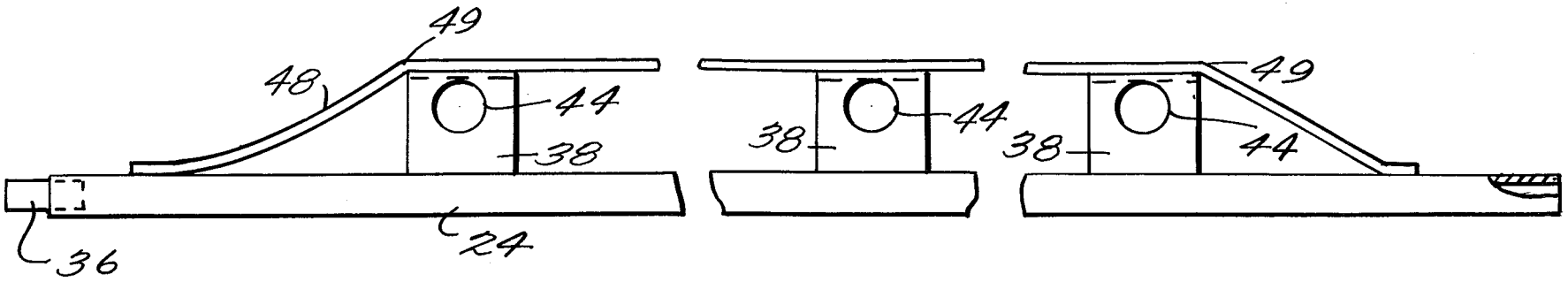
FIG. 4 is a top view of a section of a cross member illustrating the reinforcing means and post connections.
Figure 5:
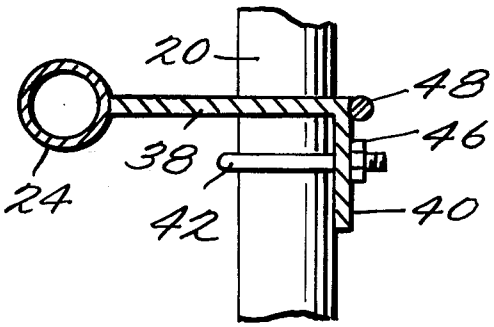
FIG. 5 is a view taken along lines 5—5 of FIG. 1.

Referring now to FIGS. 4 and 5, there is illustrated the reinforcing means for the cross members and vertical posts of the present invention which also serve, in part, as the means interconnecting the cross members to the vertical posts at the intersections thereof in the grid pattern 10.

As illustrated in FIG. 5, each cross member has welded thereto a bracket including plate member 38 with the plate member extending parallel to the longitudinal axis of the cross member. Each bracket has a depending flange 40 which is provided with through bores for receiving a U-shaped clamp 42. Referring now to FIG. 4, it will be seen that a cross member 24 is provided with a plurality of evenly spaced plate members 38 along its longitudinal axis. Each plate member has an aperture 44 through which passes a portion of a vertical post 20 as illustrated in FIG. 5. In the assembled condition as shown in FIGS. 1 through 3 and 5, the U-shaped clamp 42 securely holds the plate 38 in the illustrated portion as a result of the proper tightening of the bolts 46 on the threaded ends of the U-shaped member 42.

Referring again to FIG. 4, each cross member 24 is provided with a rod 48 which together with the plate member 38 constitute a reinforcing truss. The rod 48 which is made from a carbon steel has one end thereof welded to the surface of the cross member 24 adjacent one end of the cross member and its other end welded adjacent to the other end of the cross member. Between the two welded ends of the rod 48, the rod engages preferably in tension, the exposed side of the flange 40 of each of the plates 38 as shown in FIG. 5 and is preferably welded thereto. The bends 49 are rounded to provide some give in the brackets. The ends of rod 48 should also be curved to avoid a sharp weld joint with the cross member. This feature of the present invention contributes significantly to the overall strength of the grid structure 10 since any local collision such as between girder 12 and the adjacent vertical post 20 will be transmitted along each cross member 24 more efficiently than if a simple pipe structure were being employed so that the entire grid structure is rendered capable of absorbing such a collision.

Where a doorway is located between the building's girders, according to the present invention, a door frame is located opposite the doorway but spaced inwardly therefrom. In this event, shortened cross members will be clamped to this auxiliary door frame and the vertical post or posts that intercept the auxiliary frame will simply seat in an aperture like aperture 44 provided therein.

Figure 6:
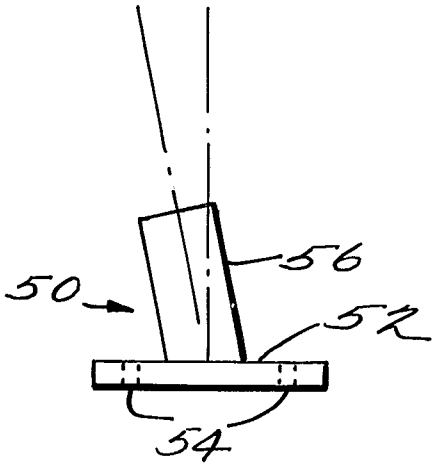
FIG. 6 is a side view in elevation of a floor plate used with the present invention.

Referring now to FIG. 6, there is illustrated a floor plate 50 which includes a flat base 52 having bores 54 to facilitate attachment of the floor plate 50 to the floor 16 of a warehouse. Extending upwardly from the base 52 is a cylindrical tube portion 56 having an internal diameter such that the lower ends of the vertical post 20 can be seated around the exterior of the tube portion 56. Where the inside edge 22 of a support girder is inclined, the tube portion 56 should be formed with an identical inclination to simplify assembly of the grid 10.

It has been found that a grid structure 10 made according to the present invention using 1020 carbon steel pipe having a two-inch diameter for the vertical posts 20 and cross members 24, using the connection means for the intersections of the post and cross members and the reinforcing truss rod 48 for each of the cross members 24, will provide a very efficient and durable protective frame for the wall of a warehouse structure. By using for the post 20 and cross member 24 hollow steel pipes, both assembly and disassembly of the grid structure can be inexpensively and rapidly effected since the only rigid attachment of the grid structure 10 to the existing warehouse structure is through the floor plates 50.

It will be appreciated that the spacing between the cross members 24 and the wall that is to be protected may be varied by employing spacing members on the adjacent girders 12 and 14 along the inside edge 22 thereof. For example, wooden beams having the same width as the faces 34 of the girders 12 and 14 may be secured to the faces 34 by any suitable means.

While the foregoing has been a description of a preferred embodiment of the invention, it will be apparent to those skilled in this art that various modifications may be made thereto without departing from the spirit and scope of the invention as defined in the appended claims.

What is claimed is:

1. A protective frame for the wall of a structure of the type having a plurality of generally vertically extending beams for supporting the wall of the structure, said protective frame comprising a plurality of vertical posts extending from the floor of the structure and spaced apart between adjacent beams thereof with said posts being spaced a selected distance from the wall, a plurality of generally horizontally extending cross members spaced apart vertically along said vertical posts and with said vertical posts being disposed between said cross members and the wall of the structure, each said cross member having one end secured to one of the adjacent beams and its other end secured to the other of the adjacent beams such that said posts and cross members define a grid structure of intersecting posts and cross members between the adjacent beams, each of said cross members having reinforcing means including means connecting each said cross member to a said vertical post at each intersection of a said post and a said cross member, said reinforcing means including a plurality of bracket members welded to each said cross member and evenly spaced therealong a distance corresponding to the distance between said vertical posts and a rod member having one end welded to said cross member adjacent one end thereof and its other end welded to said cross member adjacent to the other end thereof with said rod member in engagement with each of said bracket members located between the ends of said cross member.

2. The protective frame as claimed in claim 1, wherein said bracket members extend generally horizontally from said cross members and each of said bracket members is provided with an aperture through which a said vertical post extends, each of said bracket members having at its end remote from said cross member a vertically extending flange, a U-bolt surrounding a said vertical post and being secured to said flange.

3. The protective frame as claimed in claim 1, including floor plates for each of said vertical posts, said floor plates each having a member for engaging the end of a said vertical post, said floor plates being secured to the floor of said structure.

4. The protective frame as claimed in claim 1 wherein each said cross member is releasably secured at each end thereof to the beams.

* * * * *